US007581739B2

(12) United States Patent
Fraley

(10) Patent No.: US 7,581,739 B2
(45) Date of Patent: Sep. 1, 2009

(54) SKATEBOARD DECK AND SPRING-BASED TRUCK

(75) Inventor: James J. Fraley, Encinitas, CA (US)

(73) Assignee: Pluto Technologies, Inc., Carlsbad, CA (US)

( * ) Notice: Subject to any disclaimer, the term of this patent is extended or adjusted under 35 U.S.C. 154(b) by 0 days.

(21) Appl. No.: 11/962,946

(22) Filed: Dec. 21, 2007

(65) Prior Publication Data

US 2009/0160143 A1 Jun. 25, 2009

(51) Int. Cl.
*B62M 1/00* (2006.01)

(52) U.S. Cl. ..... 280/87.041; 280/602

(58) Field of Classification Search ..... 280/11.12, 280/11.27, 11.28, 87.041, 87.042, 87.043, 280/601, 602

See application file for complete search history.

(56) References Cited

U.S. PATENT DOCUMENTS

| | | | | | |
|---|---|---|---|---|---|
| 2,572,133 | A * | 10/1951 | Glenn | 280/11.28 |
| 3,300,226 | A * | 1/1967 | Reed, Jr. | 280/602 |
| 4,089,536 | A | 5/1978 | Larrucea | |
| 4,140,326 | A * | 2/1979 | Huber | 280/87.042 |
| 4,152,001 | A | 5/1979 | Christianson | |
| 4,199,165 | A | 4/1980 | Spitzke | |
| 5,132,883 | A * | 7/1992 | La Lumandier | 362/466 |
| 5,267,743 | A | 12/1993 | Smisek | |
| 5,622,759 | A * | 4/1997 | Fuster | 428/40.2 |
| 6,105,978 | A * | 8/2000 | Vuerchoz | 280/11.27 |
| 6,182,986 | B1 * | 2/2001 | Smith | 280/87.042 |
| 6,224,076 | B1 * | 5/2001 | Kent | 280/87.042 |
| 6,523,837 | B2 | 2/2003 | Kirkland | |
| 6,527,284 | B2 * | 3/2003 | Bert | 280/87.041 |
| 6,536,788 | B1 | 3/2003 | Kuncz et al. | |
| 6,547,262 | B1 * | 4/2003 | Yamada et al. | 280/11.28 |
| 6,863,283 | B1 * | 3/2005 | Houston et al. | 280/11.225 |
| 7,104,558 | B1 * | 9/2006 | Saldana | 280/87.042 |
| 7,246,568 | B1 | 7/2007 | Cheung | |
| 7,341,260 | B1 * | 3/2008 | Hosoda et al. | 280/11.19 |
| 7,360,782 | B2 * | 4/2008 | Gignoux | 280/602 |
| 2001/0019198 | A1 | 9/2001 | Wolf | |
| 2004/0188967 | A1 * | 9/2004 | Gallo | 280/87.041 |
| 2006/0103098 | A1 | 5/2006 | Esposito et al. | |
| 2007/0108733 | A1 * | 5/2007 | Heil et al. | 280/602 |

* cited by examiner

*Primary Examiner*—Christopher P Ellis
*Assistant Examiner*—John D Walters
(74) *Attorney, Agent, or Firm*—Hogan & Hartson LLP

(57) ABSTRACT

A skateboard comprises a deck including a first layer formed of synthetic material, a second layer formed of synthetic material and substantially coplanar with the first layer, and a middle layer substantially coplanar with and coupled between the first layer and the second layer. The middle layer is formed of synthetic material defining an elongated opening extending lengthwise from a front portion of the deck to a rear portion of the deck. An elongated member is formed of spring steel extending lengthwise within the elongated opening and spaced from at least one surface thereof to allow relative movement between the elongated member and the elongated opening. A truck assembly includes a baseplate coupled to the second layer and having a pivot arm hole, a first kingpin hole and a spring holder. The truck assembly further includes an axle housing having a second kingpin hole, a first and second end.

16 Claims, 8 Drawing Sheets

SKATEBOARD DECK AND SPRING-BASED TRUCK

BACKGROUND OF THE INVENTION

Conventional skateboard decks are manufactured out of plywood laminates using woods such as Canadian maple. Grip tape is applied to the top surface of the deck to provide a non-skid surface for a user. Trucks are mounted on the front and rear ends of the bottom surface of the deck. Each truck includes a baseplate that is bolted directly to the deck, and an axle housing attached to the baseplate by a kingpin. Wheels are attached to the respective ends of the axle housing. Decks are often customized by applying banners, logos, advertisements and graphics onto the bottom surface of the deck. Decks are typically solid throughout, except for the truck mounting chambers. Rubber grommets are provided between the axle housing and baseplate for shock absorption.

This conventional construction presents several problems. Wooden decks are easily damaged by impacts that will result in lower performance over time as the damage alters the deck's flex characteristics and structural integrity. Impacts to the bottom of the deck will also deface logos and graphics. The wood grain pattern of each deck is unique such that the performance characteristics of each deck is inconsistent. Therefore, wooden decks do not provide a durable and consistent user experience.

Likewise, the rubber grommets of conventional trucks will steadily deteriorate with use such that the shock absorption and performance of the trucks degrades quickly and is inconsistent over time. FIG. 5 illustrates a rubber grommet truck suspension system 50 including rubber grommets 53 and 54 that dampen shocks and vibrations. Metal sleeves 55 and 56 cover respective grommets 53 and 54. Rubber grommet 53 is provided between an axle housing 51 and baseplate 52, and rubber grommet 54 is provided between the axle housing 51 and nut 57 of kingpin 58. Rubber grommets act only to dampen shocks and minimize feedback into the skateboard deck. Conventional grommets act as dampers to dissipate shocks and vibrations from a user. The energy used to compress a grommet is largely dissipated. The grommets can also be worn down by friction and pressure, and thus may have difficulty in providing a durable and consistent user experience. Rubber grommets also absorb the energy a user may want to redirect into the upward motion of the board, for example, when performing jumps or tricks.

Another drawback of conventional designs is that in order to adjust the nut 57 of kingpin 58, a user must hold the bolt at one end and screw the nut 57 at the other end. Therefore, adjusting the truck 50 is a tedious process that is difficult to do in the field.

In some conventional trucks, springs are incorporated as resistance members to control the wheel tilt and turning radius of the skateboard. The springs are mounted at a slight angle from the plane of the deck in order to control the degree of turning relative to a lateral force applied to the deck. For example, when a user's weight is shifted to the right or left side of the deck, the wheel axle of the truck will tilt relative to the deck, thereby changing the rolling direction of the wheels. Separate springs are typically provided on each side of the wheel axle. Different spring tensions will alter the turning radius of the skateboard by resisting lateral force.

SUMMARY OF THE INVENTION

In one embodiment of the invention, a skateboard deck includes a first layer formed of synthetic material, a second layer formed of synthetic material and substantially coplanar with the first layer and a middle layer substantially coplanar with and coupled between the first layer and the second layer. The middle layer is formed of synthetic material defining an elongated opening extending lengthwise from a front portion of the deck to a rear portion of the deck. An elongated member is formed of spring steel extending lengthwise within the elongated opening and spaced from at least one surface thereof to allow relative movement between the elongated member and the elongated opening. The elongated opening is a channel covered by the first layer or the second layer. The elongated opening is a chamber enclosed within the middle layer. The elongated opening is a first elongated opening and wherein the middle layer defines at least one additional elongated opening adjacent to the first elongated opening and extending lengthwise from the front portion to the rear portion. At least one additional elongated member extends lengthwise within the respective at least one additional elongated opening. A front truck mounting portion is provided on the second layer. A rear truck mounting portion is provided on the second layer. A runner board is removably attached to the second layer along a lateral edge between the front truck mounting portion and the rear truck mounting portion. The runner board is attached to the deck by a plurality of screws. The runner board is rubber, formed of synthetic material or metal. The first layer includes a skid-resistant surface. The skid-resistant surface comprises a plurality of raised portions forming an image. The first layer is translucent and exposes an image surface positioned between the first layer and the middle layer. A skid plate is attached to and contoured to the shape of at least one of a front or rear edge of the second layer. A plurality of bolt head shaped holes are formed in the second layer for receiving a front truck mounting portion and a rear truck mounting portion.

In another embodiment, a truck assembly includes a baseplate including a pivot arm hole, a first kingpin hole and a spring holder. A wheel axle is couplable to a wheel on each end of the wheel axle. A pivot arm is inserted into the pivot arm hole of the baseplate. An axle housing has a second kingpin hole, a first end and a second end. The first end includes the wheel axle and the wheel axle and the second kingpin hole and the second end includes the pivot arm. A kingpin is coupled to the first kingpin hole of the baseplate and to the second kingpin hole of the axle housing. A spring member is provided substantially parallel to the kingpin and is coupled to the spring holder of the baseplate and the first end of the axle housing such that the spring member stored mechanical energy from force along an axis perpendicular to the baseplate. The spring member is provided at an angle of 60°-120° with respect to the baseplate. The second end of the axle housing includes a concave surface for grinding. The tension of the spring member is adjusted by adjusting a nut on the kingpin. A bolt head shaped chamber is formed in the baseplate, and the bolt head of the kingpin fits into the bolt head shaped chamber. The baseplate is coupled to a deck by a plurality of bolts.

In another embodiment, a skateboard includes a deck including a first layer formed of synthetic material, a second layer formed of synthetic material and substantially coplanar with the first layer, and a middle layer substantially coplanar with and coupled between the first layer and the second layer. The middle layer is formed of synthetic material defining an elongated opening extending lengthwise from a front portion of the deck to a rear portion of the deck. An elongated member is formed of spring steel extending lengthwise within the elongated opening and spaced from at least one surface thereof to allow relative movement between the elongated member and the elongated opening. A truck assembly includes a baseplate coupled to the second layer and having a pivot arm hole, a first kingpin hole and a spring holder. The truck assembly further includes an axle housing having a second kingpin hole, a first end and a second end. A wheel axle is coupled to a wheel on each end of the wheel axle. A pivot arm is inserted into the pivot arm hole of the baseplate. The first end includes the wheel axle and the second kingpin hole, and the second end includes the pivot arm. A kingpin is coupled to the first kingpin hole of the baseplate and to the second kingpin hole of the axle housing. A spring member is provided substantially parallel to the kingpin and coupled to the spring holder of the baseplate and the first end of the axle housing such that the spring member stores mechanical energy from force applied along an axis perpendicular to the baseplate.

DETAILED DESCRIPTION OF THE INVENTION

Figure 1A:
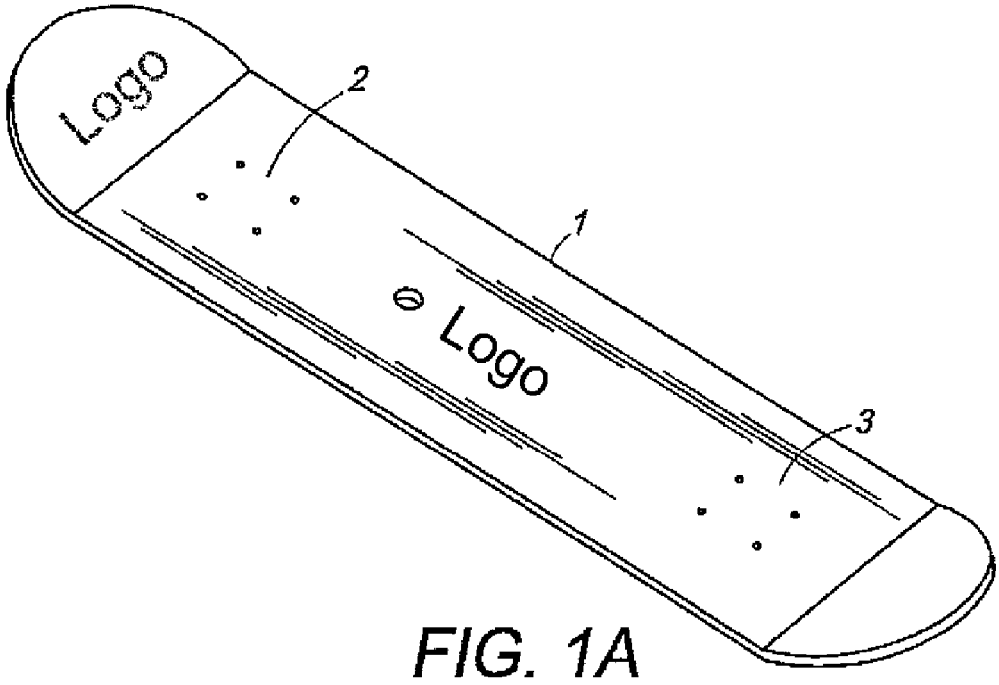
FIG. 1A is a top perspective view of the skateboard deck according to one embodiment of the invention.

FIG. 1A is a top view of the skateboard deck of one embodiment of the present invention. The deck 1 has a top layer, a middle layer and a bottom layer. The top layer is adhered to the top of the middle layer and the bottom layer is adhered to the bottom of the middle layer through, for example, molding. Intermediate layers (not shown) may also be added between the middle layer and the top or bottom layers. The length, width and thickness of the deck conform to standard skateboard dimensions, but can be modified according to desired characteristics. In the embodiment shown, the middle layer is approximately one-half inch thick. The top and bottom layers are relatively thin compared to the middle layer to minimize rigidity and, in this embodiment, are approximately 5 mm in thickness.

Truck mounting portions 2 and 3 are provided at a front and rear end of the deck. Each layer of the deck is made of a single one or combination of synthetic materials, such as fiberglass, resins, plastics, composite and Kevlar. These synthetic layers provide high impact resistance and are thus more durable and provide consistent performance over time. Decks constructed with three synthetic layers as shown show little deviation in structure or performance from one deck to the next.

The middle layer of deck 1 has elongated openings extending along the length of the deck. In this embodiment, the deck includes two elongated chambers, but the number of chambers can be varied depending on the degree of flex desired in the deck. The elongated opening can also be formed as a channel, which is covered by the top layer. Each of the openings contains an elongated member composed of spring steel that increases the flex of the deck. For purposes of this disclosure, "spring steel" refers to a metal alloy that exhibits the ability to return to an original shape after significant bending or twisting. For example, ASTM A228 is a common type of spring steel known as "music wire." The elongated member is narrower than the chamber and is thus able to move relative to the chamber, thereby allowing even more flex to the deck before the spring steel is deformed. In an alternate embodiment, the openings are empty to reduce the weight of the deck while still increasing the flexibility of the deck over the conventional solid decks.

Conventionally, chambers in a deck are filled either with decorative elements that serve no structural purpose other than to decrease deck strength, or are filled with stiffening elements that increase the rigidity and decrease the flex of the deck. Contrary to this conventional wisdom, however, increasing the flex of the deck while maintaining strength by inserting spring steel into the chambers of the middle layer improves the user's ability to perform tricks by providing additional "snap" to the deck.

Figure 1B:
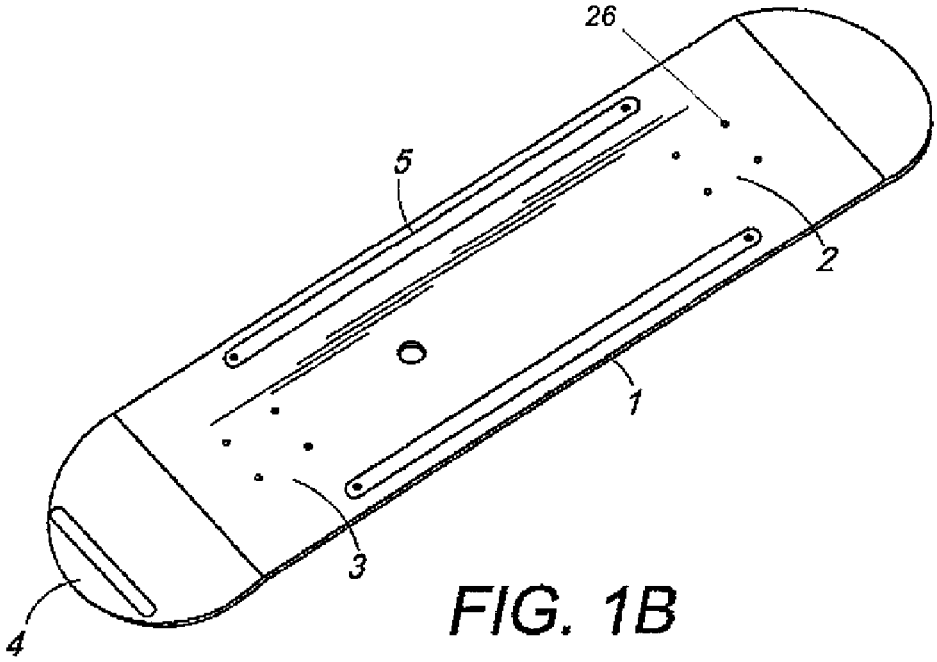
FIG. 1B is a bottom perspective view of the skateboard deck shown in FIG. 1A.
Figure 1C:
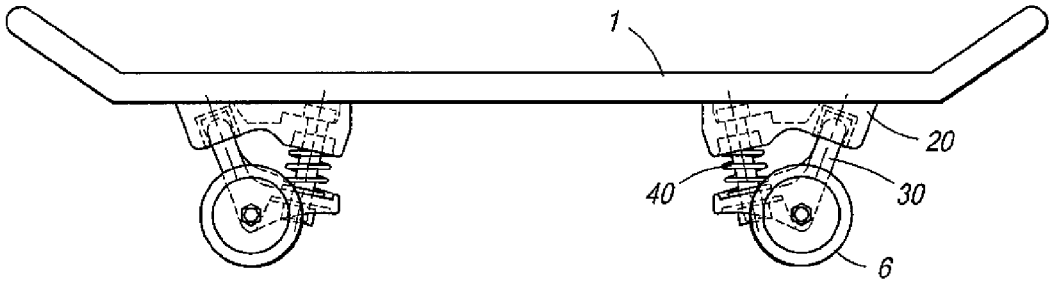
FIG. 1C is a side perspective view of an assembled skateboard according to one embodiment of the invention.
Figure 1D:
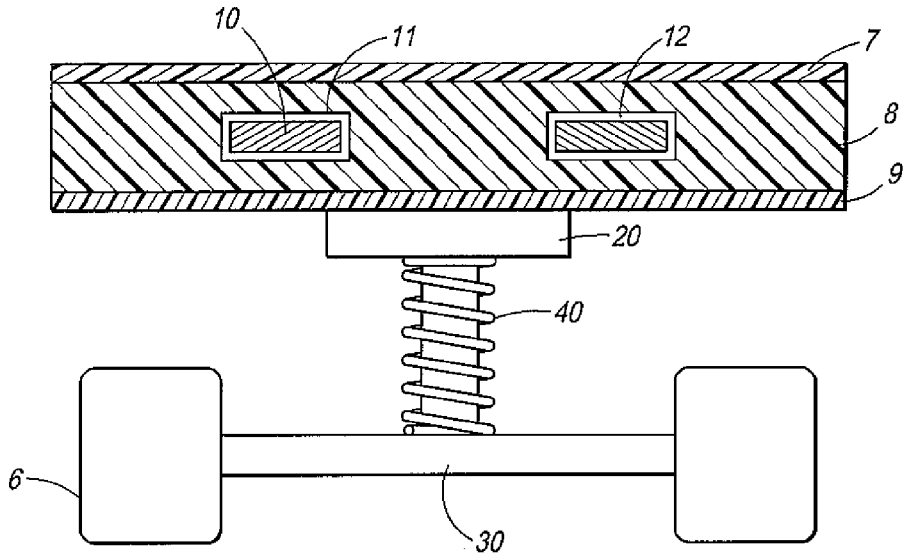
FIG. 1D is a front cross-sectional view of the skateboard shown in FIG. 1C.

FIG. 1C is a side view of a skateboard having a deck 1 attached to trucks and wheels 6. Truck components 20, 30 and 40 will be discussed in greater detail below. FIG. 1D is a cross-sectional view of the different layers of the deck. A top layer 7 is adhered or molded to the top surface of middle layer 8. The bottom layer 9 is adhered or molded to the bottom surface of middle layer 8. Two or more channels 11 form the chambers of the middle layer 8. The channels run lengthwise within the deck and are provided continuously and in parallel between the front truck mounting portion 2 and the rear truck mounting portion 3. The channels are approximately one to two inches wide and are aligned with the inside track of the wheels 6 of a mounted truck, as shown in FIG. 1D.

The spring steel 10 inserted into channel 11 is thin and flat and is provided continuously through channel 11. However, spring steel 10 does not fill the entire space of channel 11. The spring steel 10 is narrower than channel 11 so that at least one of its sides are spaced from the walls of the channel 11. In this embodiment, the air gap or flex space is less than 5 mm. As forces are transferred into the deck from the user or the trucks, the spring steel 10 in the middle layer 8 will flex and redirect that energy. Once a predetermined tension level is reached in one direction, the spring steel will snap and release the energy back into the deck in the other direction, providing flex to the board and feedback to the user. The space 12 allows the spring steel additional space to flex before redirecting the energy back to the deck 1. Providing this additional space 12 can allow the spring steel 10 to flex without reducing the strength of the deck to the point of breaking the deck.

As shown in FIG. 1B, the bottom layer of deck 1 includes a skid plate 4 along the rear end of the deck that is a brake member or a grip member. A skid plate can also be provided along the front end of the deck (not shown). The skid plate can be made from a synthetic, rubber or metal material. In one embodiment, a metal skid plate can be made of flint to create sparks when sliding on another metal. In another embodiment, a rubber skid plate provides a surface for a user to grab while performing tricks, and in still yet another embodiment, a synthetic skid plate protects the deck from damage, thereby extending the life of the skateboard. The skid plate may also be a decorative light, such as an LED. The front and rear skid plates can be made of different materials to facilitate different functions. For example, the front skid plate can be metal for protection and sliding, while the rear skid plate can be rubber for grabbing.

The skid plate can be a narrow strip as shown in FIG. 1B or contoured to the semi-circular, or U shape of the front or rear end of the deck. In this embodiment, the skid plates are approximately ½ inch thick and ½ inch wide. Although many different coupling means may be suitable, the skid plates in this embodiment are attached to the deck using a plurality of screws. This allows a user to quickly change skid plates depending on usage and wear. Thus, as the skid plates are damaged, they can be easily replaced without replacing the entire deck. A typical deck will include the front and rear skid plates along with a pair of runner boards 5.

Runner boards 5 are provided on the bottom layer, running lengthwise along the edges of the deck, from the front truck mounting portion 2 to the rear truck mounting portion 3. The runner boards 5 are easily attached and removed from the deck using screws. A pair of runner boards may be provided with a single skid plate or the skid plate may be provided without any runner boards. The runner boards may be approximately one-half-inch thick and one-half-inch wide. However, one skilled in the art will understand that other shapes and thicknesses are within the scope of the invention. The runner boards 5 can be made from the same materials as the skid plates.

Similar to the skid plates, the runner boards add protection and functionality to the deck. The skid plates and runner boards improve the ride and structural integrity of the deck. Damaged skid plates and runner boards can be easily removed and replaced with new skid plates and runner boards such that the lifespan of the deck is increased. The variety of shapes and materials available also allows a user to easily modify and specialize a deck for an intended application.

The top layer 7 of deck 1 is preferably translucent such that graphic logos, banners or other images are visible when placed between the middle layer and top layer. In this manner, graphics can be seen from the bottom and/or top of the deck. The translucent top layer 7 is further provided with a skid reducing surface such as small, raised portions that provide traction for a user. The raised portions can form a texture that is in the shape of a logo, banner, graphic or advertisement. The top layer 7 and bottom layer 9 are further provided with a scratch resistant coating.

The front truck mounting portion 2 and the rear truck mounting portion 3 include a plurality of holes having a bolt head shaped cut-out 26 that fits snugly against the bolt head of a screw that connects the trucks 20 to the deck (FIG. 1B). Once inserted into the cut-out, the bolt head is secured in position and cannot turn. In this manner, a truck can be mounted onto a deck using only a single wrench.

Figure 2A:
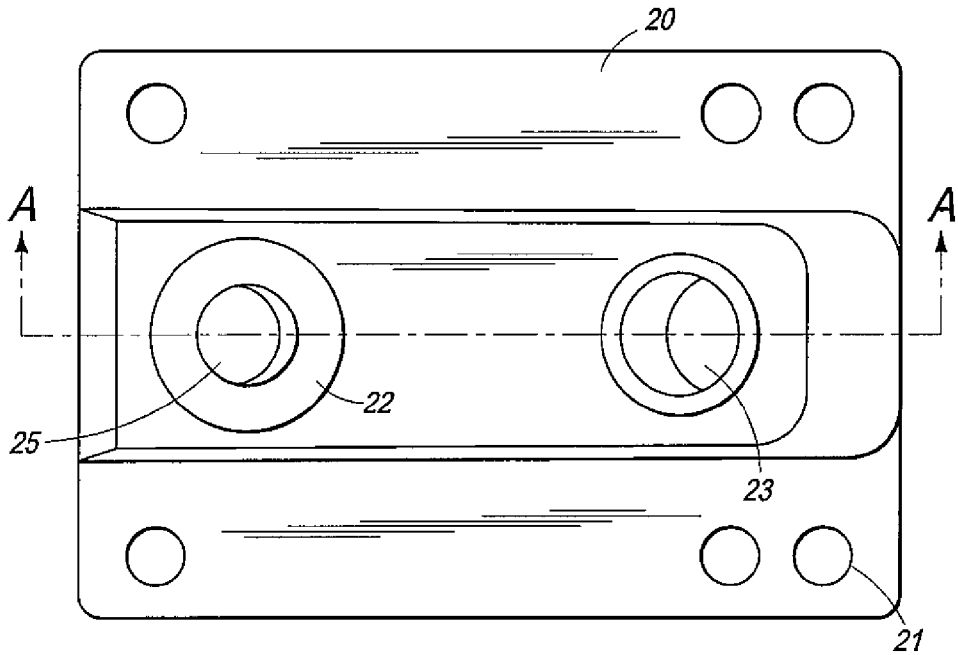
FIG. 2A is a bottom perspective view of the baseplate of a truck according to one embodiment of the invention.
Figure 2B:
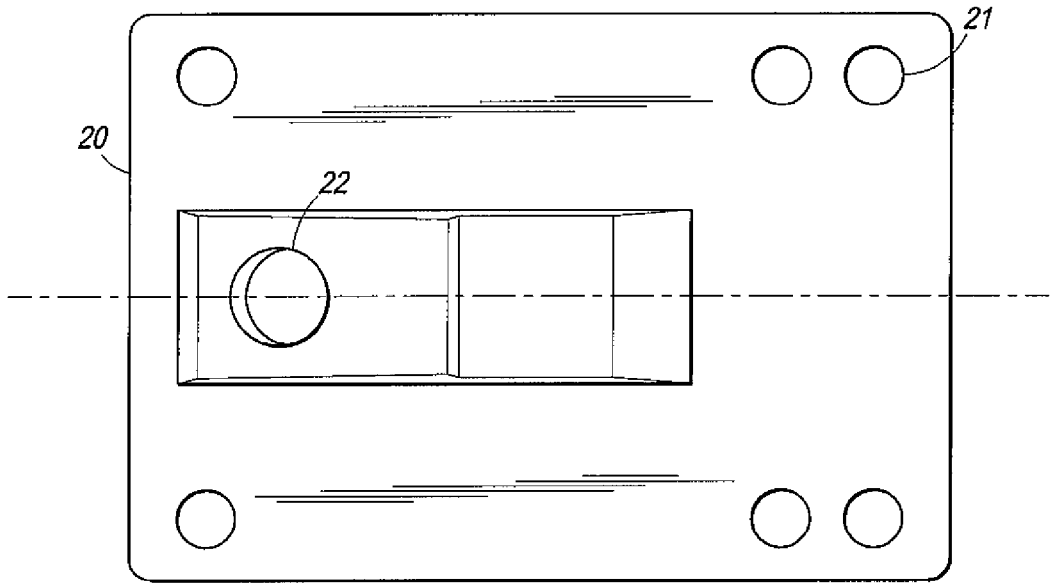
FIG. 2B is a top perspective view of the baseplate shown in FIG. 2A.
Figure 2C:
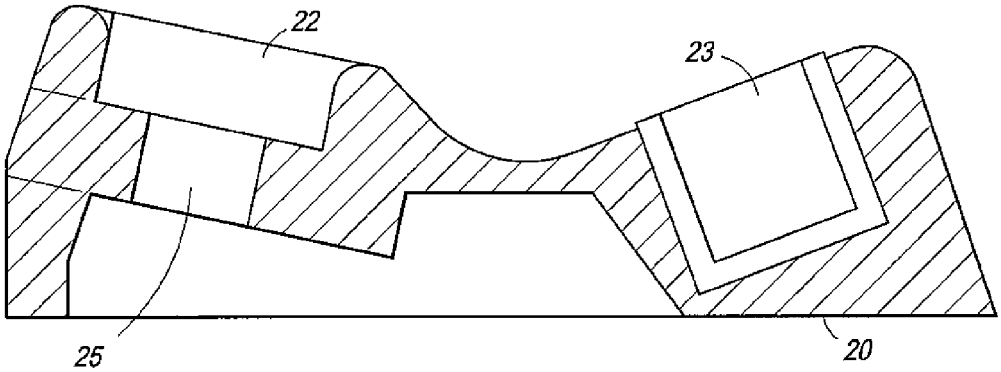
FIG. 2C is a cross-sectional view of the baseplate taken along the A-A line of FIG. 2A.
Figure 4:
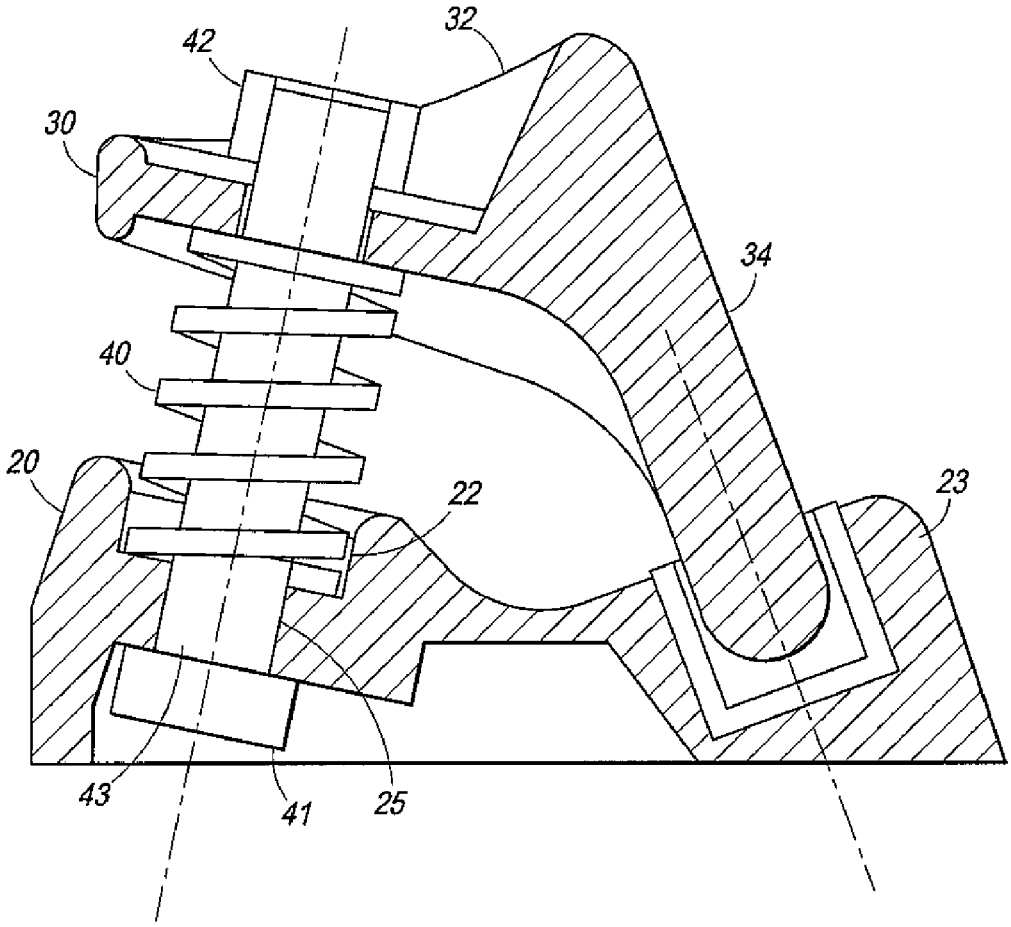
FIG. 4 is a cross-sectional view of a spring-based truck according to one embodiment of the invention.
Figure 5:
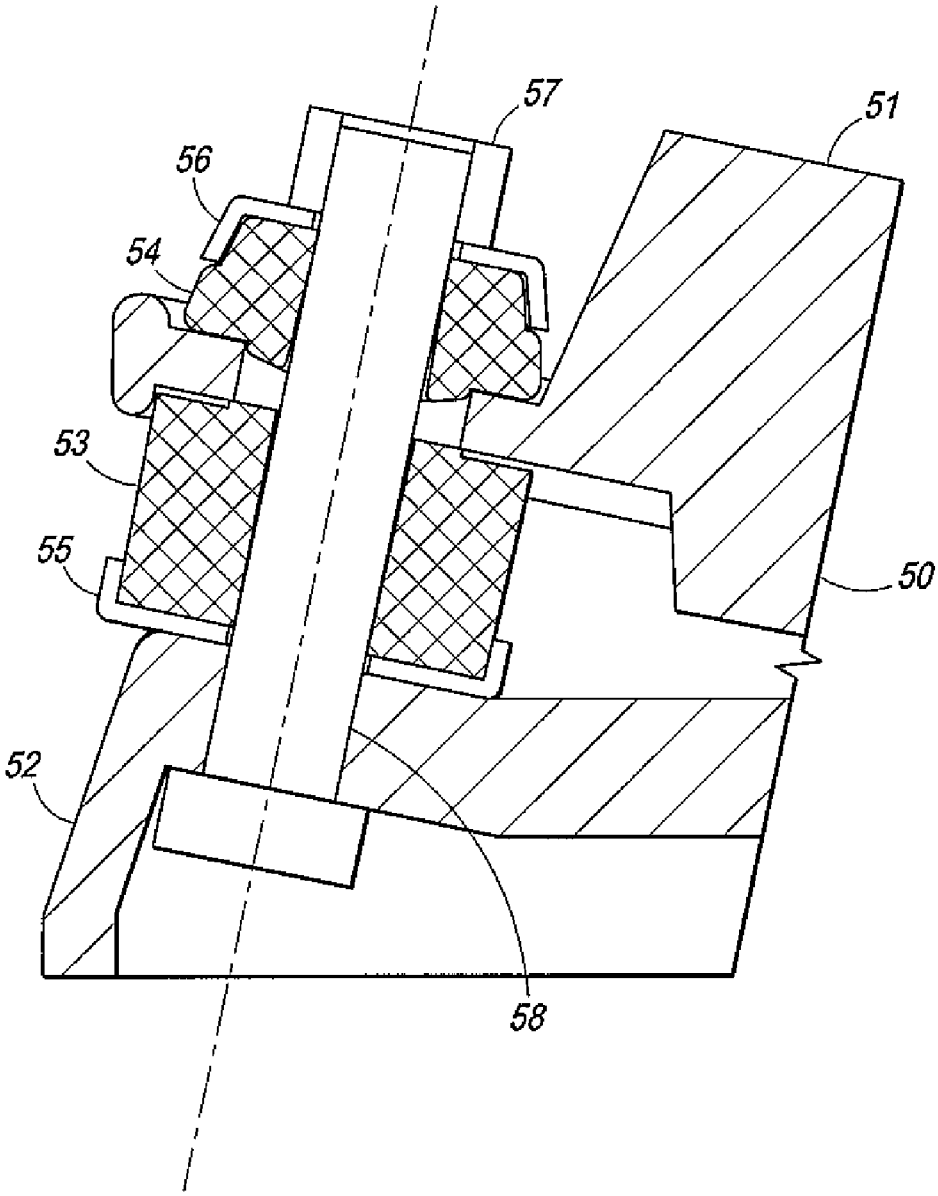
FIG. 5 Prior Art
FIG. 5 is a cross-sectional view of a conventional truck.

FIG. 4 is a cross-sectional view of the entire truck assembly, including the baseplate 20, truck 30 and spring 40, which will be discussed in detail below. In FIGS. 2A-C, the bottom, top and cross-section of baseplate 20 is shown. Baseplate 20 connects the axle housing 30 to the deck 1. A plurality of mounting holes 21 are provided to attach the baseplate 20 to the deck using screws. The location, number and size of mounting holes 21 are standardized for trucks. A pivot arm hole 23 holds the pivot arm 34 of axle housing 30 as shown in FIG. 4. As will be discussed in more detail below, the pivot arm 34 pivots within pivot arm hole 23 as a result of shocks and vibrations. First kingpin hole 25 holds the bolt end of kingpin 43 and spring holder 22 is a cavity for the spring 40 to fit into. First kingpin hole 25 and spring holder 22 are provided such that the kingpin 43 and spring 40 are substantially parallel to each other. Furthermore, the bolt head is provided as close to the deck as possible, in order to maximize the length of a spring 40. A larger and longer spring provides greater feedback and response to the deck without raising the center of gravity of the deck. For example, the clearance between the bolt head and the deck is preferably ¼ inch or less.

In one embodiment, the angle between the deck and an axis of the spring 40 is 75°. However, the spring axis can vary from 60°-120°. A spring axis of 90° provides the maximum amount of energy redirection from impacts to the deck, but an angle of 75° may provide a substantial amount of vertical energy redirection while providing the wheel axle housing with a good angle for grinding. Springs provided outside the range of 60°-120° do not allow for energy transfer and are provided for shock dampening trucks. In this embodiment, the pivot arm hole 23 is provided at approximately 115° to the deck.

As discussed above, the first kingpin hole 25 can alternatively be a bolt head shape chamber or cut-out that tightly fits the bolt head of a kingpin 43 so that the bolt head is held in place without the need for a wrench at the baseplate when the nut 42 of kingpin 43 is adjusted. In this manner, the kingpin 43 can be tightened and adjusted using only a single wrench since movement of the bolt head is minimized.

Figure 3A:
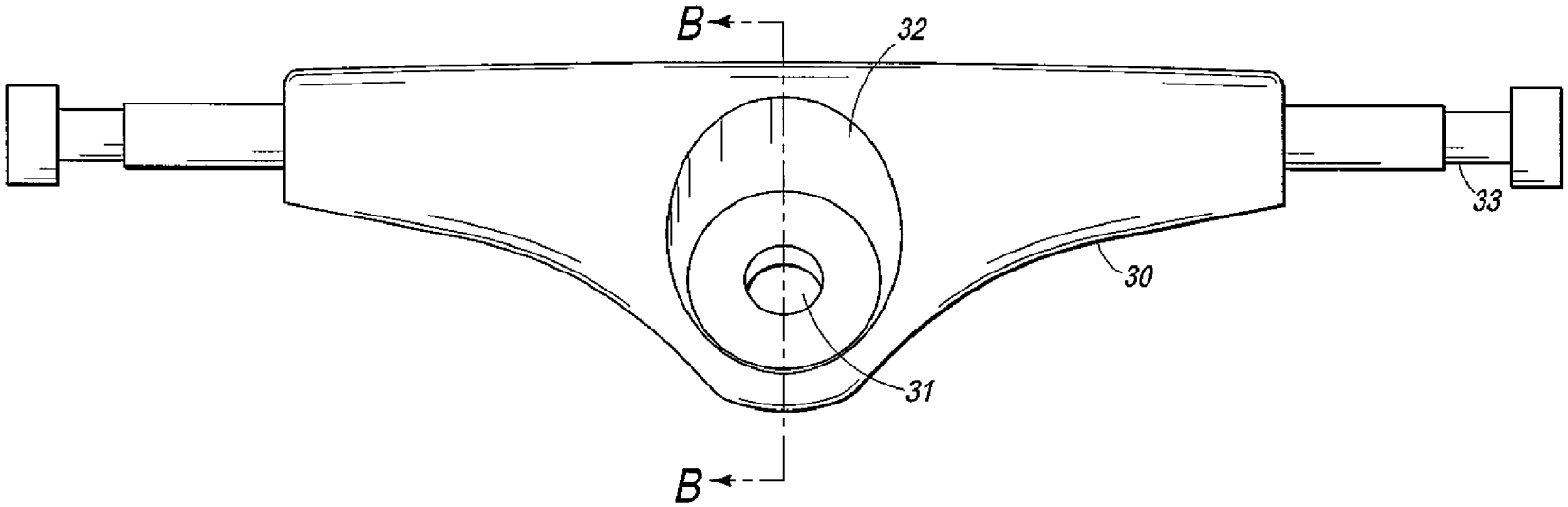
FIG. 3A is a bottom perspective view of an axle housing of a truck according to one embodiment of the invention.
Figure 3B:
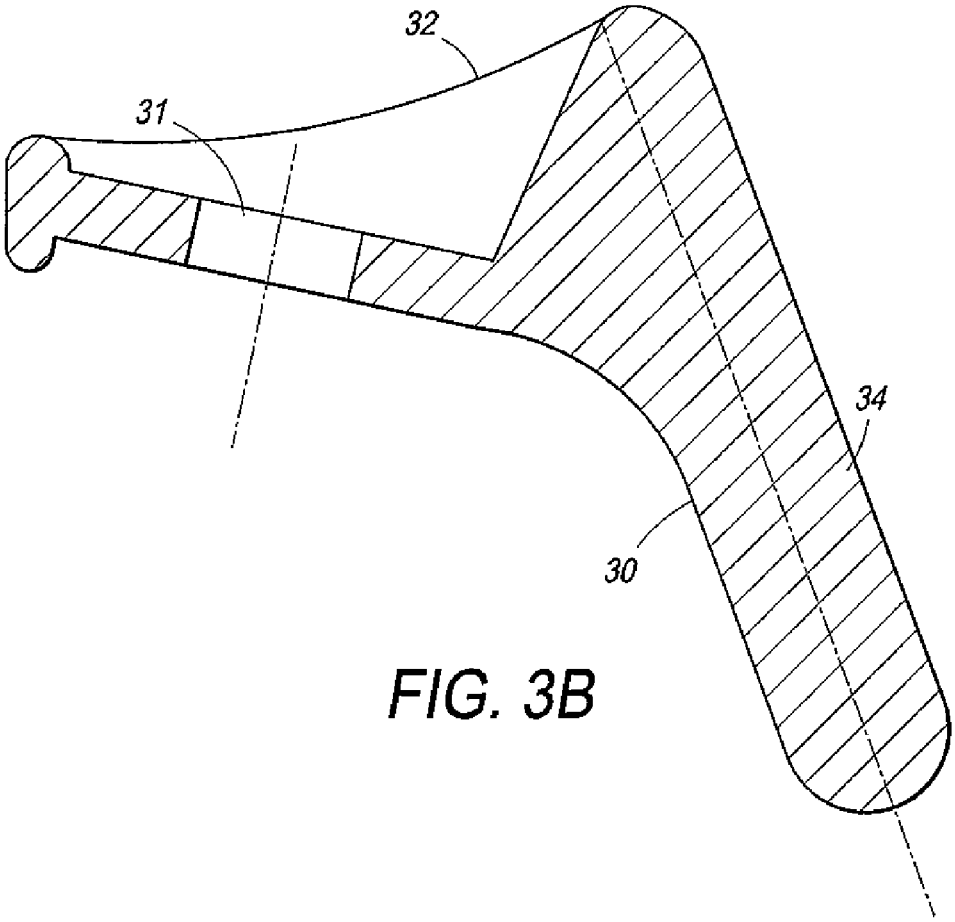
FIG. 3B is a cross-sectional view of the axle housing taken along the B-B line of FIG. 3A.

In FIGS. 3A and 3B, a bottom and cross-sectional view of axle housing 30 is shown. A first end of axle housing 30 holds a wheel axle 33 with a wheel (not shown) attached to each end. The second end of axle housing 30 includes a pivot arm 34 that is inserted into corresponding pivot arm hole 23. A second kingpin hole 31 is provided at the wheel axle end of axle housing 30 to hold the nut end of the kingpin. A concave surface 32 is provided at the first end to protect the nut against damage. As seen in FIG. 3A, second kingpin hole 31 is provided within concave surface 32. The concave surface 32 further provides a sliding surface for grinding onto a rail. The concave surface prevents a user from catching the rail between the nut 42 and axle housing 30. Furthermore, the length of the pivot arm 34 is increased over those of conventional trucks in order to allow for a longer spring 40. The angle between the first end of axle housing 30 and pivot arm 34 is approximately 125°.

With reference to FIG. 4, the nut 41 of kingpin 43 is adjustable such that the spring tension of spring 40 is easily adjustable by a user to provide a desired level of feedback. The spring 40 is provided to be as long as possible and, in this embodiment, it is in contact with the axle housing 30 and baseplate 20. Because of the angle of the spring 40 and kingpin 43, force redirection from the spring occurs primarily from vertical forces on the deck, rather than side-to-side motions, such as when a user shifts its weight on the deck to turn the skateboard. Spring 40 compresses due to front-to-back shocks and vibrations between the ground and the deck. Spring 40 does not dampen impacts, but is set to absorb kinetic energy and transfer that energy into the deck to provide snap to the user. Furthermore, the spring ends can be round or flattened.

Conventional grommets act as a dampener that will wear down as impacts are absorbed such that they quickly lose effectiveness. However, springs do not lose material due to impacts such that they provide consistent performance over a longer lifespan. Furthermore, spring 40 acts to transfer energy into the deck.

The spring based trucks and synthetic deck enhance the flex and feedback of the board, to provide the user with maximum snap. Improved flex and maximum feedback or snap improves a user's ability to perform tricks and jumps. These embodiments also improve the durability and consistency of a user's experience.

The embodiments of the present invention are not limited to skateboards and can be used in in-line skates or the like. Modification to the particular embodiments of the invention described herein may be made without departing from the spirit and scope of the invention. The described embodiments are illustrative and not restrictive, and the scope of the invention is indicated by the appended claims, rather than the foregoing description. All modifications which come within the meaning and range of equivalency of the claims are therefore intended to be embraced therein.

The invention claimed is:

1. A skateboard deck comprising:

a first layer formed of synthetic material;

a second layer formed of synthetic material and substantially coplanar with the first layer;

a middle layer substantially coplanar with and coupled between the first layer and the second layer, the middle layer formed of synthetic material defining an elongated opening extending lengthwise from a front portion of the deck to a rear portion of the deck; and an elongated member formed of spring steel extending lengthwise within the elongated opening and spaced from at least one surface thereof to allow relative movement between the elongated member and the elongated opening through an air space, wherein the air space is provided between the elongated opening and the elongated member.

2. The skateboard deck according to claim 1, wherein the elongated opening is a channel covered by the first layer or the second layer.

3. The skateboard deck according to claim 1, wherein the elongated opening is a chamber enclosed within the middle layer.

4. The skateboard deck according to claim 1, wherein the elongated opening is a first elongated opening and wherein the middle layer defines at least one additional elongated opening adjacent to the first elongated opening and extending lengthwise from the front portion to the rear portion.

5. The skateboard deck according to claim 4, further comprising at least one additional elongated member extending lengthwise within the respective at least one additional elongated opening.

6. The skateboard deck according to claim 1, further comprising:

a front truck mounting portion on the second layer;

a rear truck mounting portion on the second layer; and a runner board removably attached to the second layer along a lateral edge between the front truck mounting portion and the rear truck mounting portion.

7. The skateboard deck according to claim 6, wherein the runner board is attached to the deck by a plurality of screws.

8. The skateboard deck according to claim 6, wherein the runner board is rubber.

9. The skateboard deck according to claim 6, wherein the runner board is formed of synthetic material.

10. The skateboard deck according to claim 6, wherein the runner board is metal.

11. The skateboard deck according to claim 1, wherein the first layer includes a skid-resistant surface.

12. The skateboard deck according to claim 11, wherein the skid-resistant surface comprises a plurality of raised portions forming an image.

13. The skateboard deck according to claim 1, wherein the first layer is translucent and exposes an image surface positioned between the first layer and the middle layer.

14. The skateboard deck according to claim 1, further comprising:

a skid plate attached to and contoured to the shape of at least one of a front or rear edge of the second layer.

15. The skateboard deck according to claim 1, further comprising:

a plurality of bolt head shaped holes formed in the second layer for receiving a front truck mounting portion and a rear truck mounting portion.

16. A skateboard, comprising:

a deck including a first layer formed of synthetic material, a second layer formed of synthetic material and substantially coplanar with the first layer, and a middle layer substantially coplanar with and coupled between the first layer and the second layer, the middle layer formed of synthetic material defining an elongated opening extending lengthwise from a front portion of the deck to a rear portion of the deck;

an elongated member formed of spring steel extending lengthwise within the elongated opening and spaced from at least one surface thereof to allow relative movement between the elongated member and the elongated opening;

a truck assembly including a baseplate coupled to the second layer and having a pivot arm hole, a first kingpin hole and a spring holder, the truck assembly further including an axle housing having a second kingpin hole, a first end and a second end;

a wheel axle coupled to a wheel on each end of the wheel axle;

a pivot arm inserted into the pivot arm hole of the baseplate;

the first end including the wheel axle and the second kingpin hole, and the second end including the pivot arm;

a kingpin coupled to the first kingpin hole of the baseplate and to the second kingpin hole of the axle housing;

a non-elastomeric spring member provided substantially parallel to the kingpin and coupled to the spring holder of the baseplate and the first end of the axle housing such that the non-elastomeric spring member stores mechanical energy from force applied along an axis perpendicular to the baseplate.

* * * * *